US006839990B2

(12) United States Patent
Leslie et al.

(10) Patent No.: US 6,839,990 B2
(45) Date of Patent: Jan. 11, 2005

(54) EXCAVATOR TEETH

(75) Inventors: Bruce Alexander Leslie, Queensland (AU); Thomas Anthony Meyers, 39 Annie Wood Avenue, Mackay, Queensland (AU), 4740

(73) Assignee: Thomas Anthony Meyers, Queensland (AU)

( * ) Notice: Subject to any disclaimer, the term of this patent is extended or adjusted under 35 U.S.C. 154(b) by 16 days.

(21) Appl. No.: 10/262,059

(22) Filed: Oct. 1, 2002

(65) Prior Publication Data

US 2003/0061744 A1 Apr. 3, 2003

(30) Foreign Application Priority Data

Oct. 2, 2001 (AU) ..... PR8034

(51) Int. Cl.[7] ..... E02F 9/28
(52) U.S. Cl. ..... 37/452; 37/455
(58) Field of Search ..... 37/452, 455, 456, 37/453, 454

(56) References Cited

U.S. PATENT DOCUMENTS

| | | | | | |
|---|---|---|---|---|---|
| 1,485,879 | A | * | 3/1924 | Page | 37/455 |
| 1,697,536 | A | * | 1/1929 | Miley | 37/455 |
| 1,783,350 | A | * | 12/1930 | Watts | 37/454 |
| 2,311,463 | A | * | 2/1943 | Page | 37/455 |
| 2,385,395 | A | * | 9/1945 | Baer | 37/458 |
| 2,393,706 | A | * | 1/1946 | Page | 37/455 |
| 3,196,956 | A | | 7/1965 | Ratkowski | 172/713 |
| 3,371,437 | A | * | 3/1968 | Wilson et al. | 37/455 |
| 4,204,349 | A | * | 5/1980 | Tallis | 37/448 |
| 4,205,469 | A | * | 6/1980 | Johansson et al. | 37/457 |
| 4,642,920 | A | * | 2/1987 | Lehnhoff | 37/452 |
| 5,423,138 | A | | 6/1995 | Livesay et al. | 37/456 |
| 5,709,043 | A | | 1/1998 | Jones et al. | 37/458 |
| 5,713,145 | A | * | 2/1998 | Ruvang | 37/458 |
| 5,718,070 | A | | 2/1998 | Ruvang | 37/459 |
| 6,240,663 | B1 | * | 6/2001 | Robinson | 37/458 |

* cited by examiner

*Primary Examiner*—Thomas B. Will
*Assistant Examiner*—Alexandra K. Pechhold
(74) *Attorney, Agent, or Firm*—Buckingham, Doolittle & Burroughs, LLP; Louis F. Wagner

(57) ABSTRACT

A mounting system for a digging tooth of an excavator bucket has an adaptor nose with upper and lower bearing surfaces tapering convergently towards a free end thereof. A digging tooth having a convergently tapering socket locates on said adaptor nose with a screw-threaded connector extending, in a direction parallel to a longitudinal axis of said tooth, between a connector abutment on the adaptor nose and a tooth coupling on the tooth.

16 Claims, 4 Drawing Sheets

FIG. 6
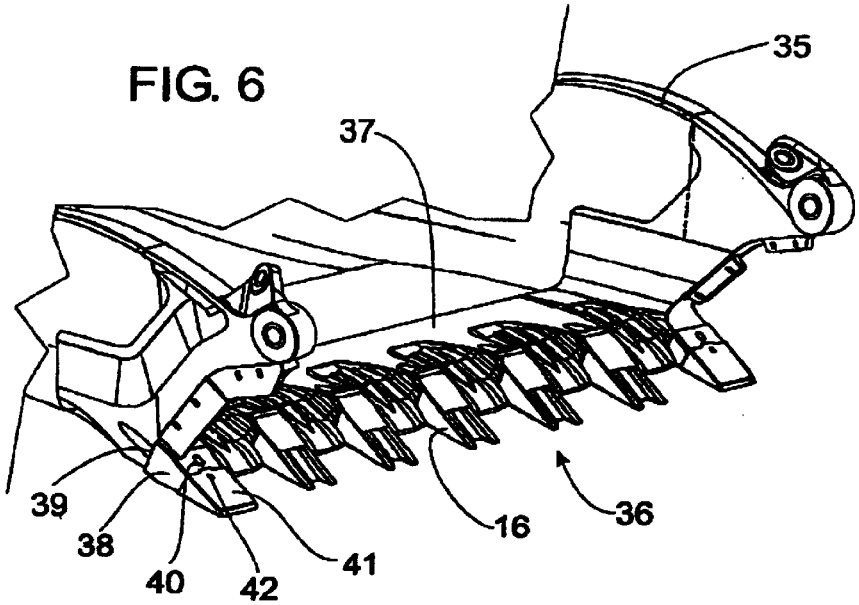
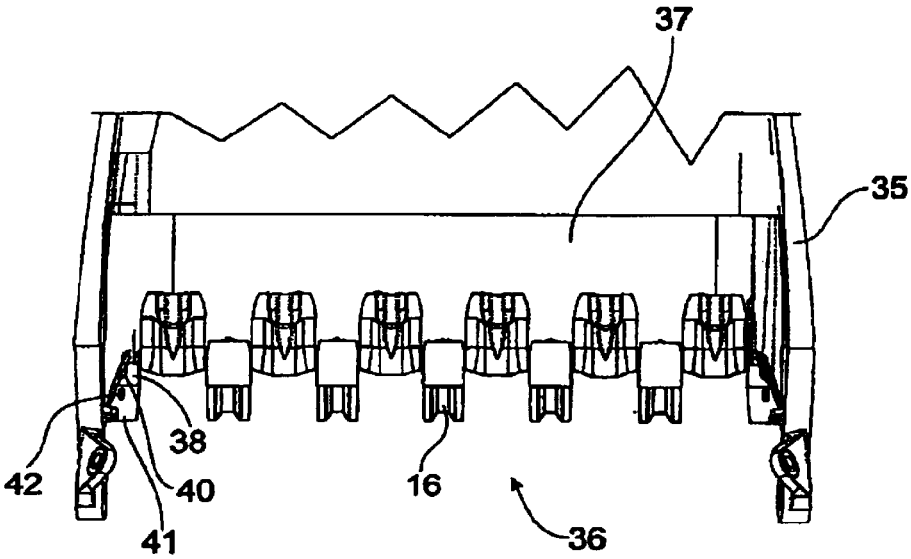
FIG. 7

EXCAVATOR TEETH

FIELD OF THE INVENTION

This invention is concerned with improvements in earth working implements of the type having replaceable ground engaging elements or teeth which are subject to wear.

The invention is particularly, although not exclusively, concerned with releasable retention of excavating tooth components on excavating buckets and other excavation apparatus.

BACKGROUND OF THE INVENTION

Generally speaking, excavator buckets have on their front lip, spaced forwardly tapered spigots known as "noses" to which a tooth adaptor with a replaceable tooth is fitted.

This permits ready replacement of the teeth as they wear on a frequent basis and ready replacement of the adaptor—essentially the bulky rear portion of a tooth, on a less frequent basis.

Prior art adaptors have been retained on the bucket lip noses by frictional engagement with a large pin driven through aligned apertures in the adaptor and the nose. In some cases however, the adaptors are welded directly onto the lip as described in U.S. Pat. No. 5,709,043.

Replacement of an adaptor is effected by driving out the retaining pin to enable disengagement between the tapered spigot-like nose projection and a tapered complementary socket-like recess in the body of the adaptor. In the case of welded on adaptors, the worn adaptor must be cut from the lip with angle grinders, oxy-acetylene cutters or the like which is a very time consuming process to replace a worn adaptor.

There are however a number of disadvantages associated with prior art pinning systems in common use.

The most commonly used pinning system is known as a spool and wedge system which is inserted into aligned apertures in the nose and adaptor along an upright axis.

The spool and wedge system comprises a spool member having a tapered inner face which engages a complementary tapered face on the wedge such that relative longitudinal movement between the tapered faces causes an effective radial expansion or contraction in a plane orthogonal to the respective tapered faces.

In use, the spool member is first located in the aligned apertures of a nose and adaptor and the wedge member, with its tapered face in contact with the tapered face of the spool member, is then manually driven forcibly into the aligned apertures with a large sledgehammer having a mass of about 13 kg.

As the forces applied to a tooth/adaptor combination during excavation can be extreme and applied in many directions, it is essential to maintain a tight fit between the adaptor and nose to avoid excessive wear.

Accordingly substantial impact forces must be applied to the wedge to pull the adaptor, having a mass of several hundred kilograms, into close fitting engagement with the nose and otherwise to provide sufficient frictional force to the spool and wedge to retain the pin system in place during use.

Other devices for retaining excavator teeth on adaptors may be flex pins having two metal members separated by an elastomeric compound. When driven into aligned apertures between a tooth and an adaptor nose, the elastomeric compound is compressed against a restoring force which is said to urge the tooth into tighter engagement with the nose.

Flex pin type retention systems are subject to premature wear and deterioration in use.

Dragline maintenance staff have shown interest in alternative methods of attaching adaptors due to the high incidence of injury such as back strain, impact injuries from misdirected or glancing hammer blows and high velocity metal projectiles broken from the wedge during impact. Even after attachment, it is necessary to interrupt the operation of a dragline after some hours to tighten up the wedge.

Another significant disadvantage is the tendency to these spool and wedge pin systems to "walk" relative to each other due to large rotational moment forces applied to the adaptors during excavation. As the pins loosen, it Is common place to lose an adaptor during emptying of the excavator bucket and this necessitates immediate cessation of the excavator operation to replace the missing adaptor.

Investigations have shown that apart from the cost of replacing lost adaptor/tooth combinations a typical excavator will experience about. 24 hours down time each year at a cost of $8000–$10,000 per hour to replace lost adaptors.

Although a number of proposals for improved adaptor retention systems having been made, these have not been widely accepted.

Other prior art proposals for improved adaptor retention system are described in U.S. Pat. Nos. 5,718,070, 5,709,043, 3,196,956 and 5,423,138.

U.S. Pat. No. 5,718,070 describes an adaptor/tooth mounting arrangement wherein a wedge shaped connector pin extends through relatively large aligned apertures extending transversely in the tooth and adaptor nose. The pin is wedgingly engaged at one end and secured at its other end by a spring-loaded rotatable connector.

U.S. Pat. No. 5,423,138 describes a mounting for a tooth on an adaptor nose wherein a retaining pin extends transversely of an aperture in the nose but the free ends of the pin are located in blind recesses in the tooth by pins extending through vertical apertures in the tooth.

U.S. Pat. No. 3,196,956 also describes amounting for a tooth on an adaptor wherein a pin is located in aligned transversely extending apertures in the adaptor nose and the tooth.

U.S. Pat. No. 5,709,043 describes an adaptor having a large laterally extending recess to locate a laterally extending spring pin, a free end of which locates in one of a pair of aligned apertures in opposite sides of the tooth socket.

Other prior art tooth/adaptor mounting systems may employ aligned vertical apertures to receive a locking pin, spool and wedge, flex pin or the like.

In use the bucket lip, adaptor and tooth are subjected to a variety of load forces applied in differing directions. The greatest loads are those which apply downward rotational moment in an upright plane which moment acts to rotate the tooth/adaptor nose off the bucket lip.

A difficulty with the prior art tooth/adaptor mounting systems described above is that the horizontal or vertical apertures in the adaptor nose and the tooth tend to be relatively large to accommodate a fastening device of sufficient robustness to resist the rotational moment applied in use. These relatively large apertures reduce the cross sectional area of both the adaptor nose and the tooth socket giving rise to localised weakness with consequent breakage at these weak points.

It is an aim of the present invention to overcome or ameliorate at least some of the problems associated with the prior art tooth/adaptor mounting systems.

SUMMARY OF THE INVENTION

According to one aspect of the invention there is provided a mounting system for a digging tooth, said mounting system including:

an adaptor nose having upper and lower bearing surfaces tapering convergently towards a free end of said nose, said adaptor nose having a connector abutment located in an upper portion of said nose remote from said free end; and, a digging tooth having a convergently tapering socket to receivably locate said adaptor nose, said digging tooth having a tooth coupling adapted to cooperate with a screw-threaded connector extending between said coupling and said abutment in a direction substantially parallel to a longitudinal axis of said digging tooth.

If required said adaptor nose may be formed integrally with an excavator bucket lip alternatively said adaptor nose may be formed on an adaptor member adapted, in use, for attachment to a lip of an excavator bucket.

The adaptor member may be releasably securable to said lip.

Preferably said upper and lower bearing surfaces of said nose are planar.

The digging tooth suitably has a convergently tapering socket complementary to said nose for wedging engagement therebetween.

The tooth coupling may comprise a screw-threaded aperture to receive a free end of a screw-threaded connector.

Alternatively the tooth coupling may comprise a locator for a screw-threaded connector, said screw-threaded connector having a free end extending beyond said abutment in a direction away from said tooth.

Suitably the screw-threaded connector comprises a bolt having a head engageable with said abutment or engageable with said locator.

Alternatively the screw-threaded connector may comprise a stud member.

If required the tooth may include a rearwardly extending shroud to shroud at least portion of said nose rearwardly of said bearing surfaces.

Preferably said shroud extends over said tooth coupling.

Suitably said digging tooth comprises upper and lower surfaces convergently tapering towards a free end of said tooth.

Preferably said tooth has a channelled recess extending rearwardly from a free end thereof between opposite sides of said tooth over at least a portion of an upper surface and/or lower surface of said tooth.

According to another aspect of the invention there is provided a lip for an excavator bucket, said lip including:

a body member;

a plurality of adaptor noses spaced along a leading edge of said body, said adaptor noses projecting parallel to each other away from said leading edge, said adaptor noses each having upper and lower bearing surfaces tapering convergently towards a free end thereof to receivably locate a respective digging tooth having a convergently tapering mounting socket, said lip characterised in that the digging teeth are removably secured to said lip by a screw-threaded connector extending between a tooth coupling associated with each tooth and a connector abutment located on a respective nose whereby said screw-threaded connector extends in a direction substantially parallel to a longitudinal axis of a respective tooth.

The adaptor noses may be integrally formed with the lip body or they may be secured thereto.

Preferably a leading edge portion of said lip body between adjacent adaptor noses is contoured to provide a cutting edge.

According to yet another aspect of the invention there is provided a method of removably securing digging teeth to adaptor noses as generally described herein.

According to a still further aspect of the invention there is provided an excavator bucket having a lip and removably securable teeth as generally described herein.

BRIEF DESCRIPTION OF THE DRAWINGS

In order that the various aspects of the invention may be more fully understood and put into practical effect, reference will now be made to preferred embodiments illustrated in the accompanying drawings which:

FIG. 6 is a partial perspective view of an excavator bucket fitted with a mounting system, bucket lip and digging teeth according to the invention; and FIG. 7 is a partial plan view of the arrangement of FIG. 6.

DETAILED DESCRIPTION OF THE DRAWINGS

Figure 1:
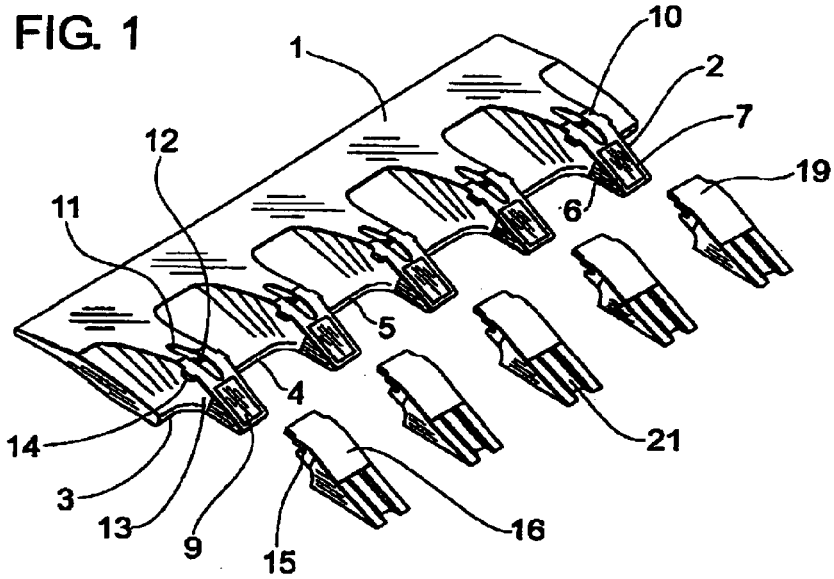
FIG. 1 shows a partial exploded upper isometric view of an excavator bucket lip and digging teeth according to the invention.

For the sake of simplicity, like reference numerals have been employed for like features in the accompanying drawings.

Figure 2:
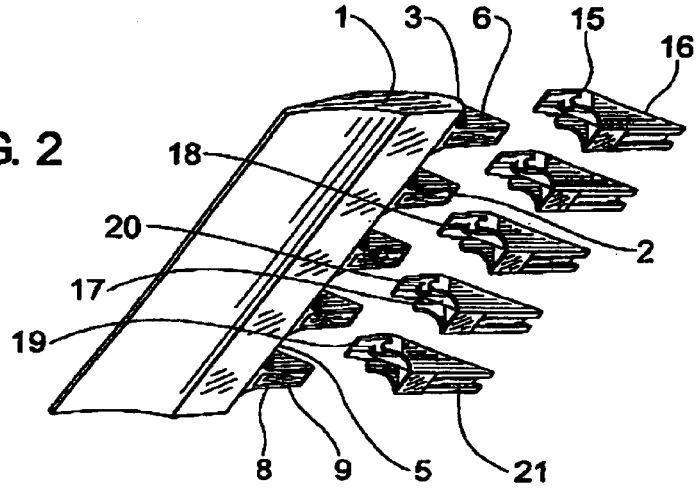
FIG. 2 shows a partial exploded lower isometric view of the lip and teeth of FIG. 1.

FIGS. 1 and 2 show portion of an excavator bucket lip 1 in the form of a steel casting having a plurality of spaced adaptor noses 2 extending from a front edge 3 thereof. The region 4 between adjacent noses 2 is relieved to form cutting edges 5 at the front edge 2 of the lip body.

Noses 2 are formed as solid members having parallel sides 6 and convergently tapering upper and lower faces 7, 8 each having a planar machined bearing face 9 formed thereon.

In the upper rearward portion 10 of noses 2 are formed slotted recesses or channels 11 of a generally semi-circular cross section. Located in each channel 11 is a generally U-shaped protrusion 12 in the side wall of each channel forming an abutment surface, the purpose of which will be described later.

The side walls 13 of noses 2 adjacent channels 11 are outwardly projecting ears 14 which slidably engage in corresponding slots 15 of digging teeth 16 when teeth 16 are located on respective noses 2.

As can be seen from FIG. 2, teeth 16 have convergently tapering sockets 17 which wedgingly engage on noses 2. Also shown in FIG. 2 are part circular channels 18 formed in an upper rearwardly extending shroud portion 19 of teeth 16. Axially aligned with channels 18 are circular or part circular fastener locating members 20 which will be described in detail later.

Teeth 16 are formed with recessed channels 21 extending over outer portions of the upper and lower surfaces of the teeth.

Figure 3:
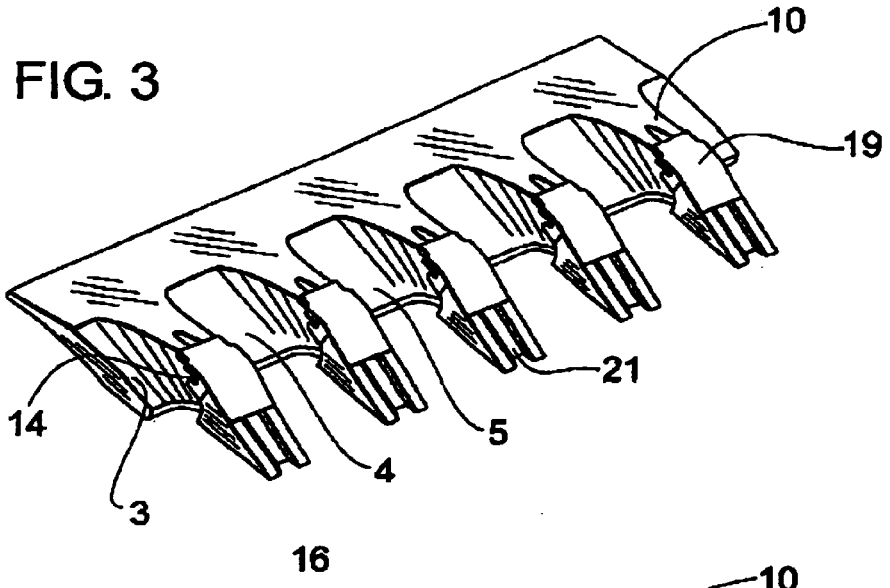
FIG. 3 shows a partial upper Isometric view of the assembly of FIG. 1.
Figure 4:
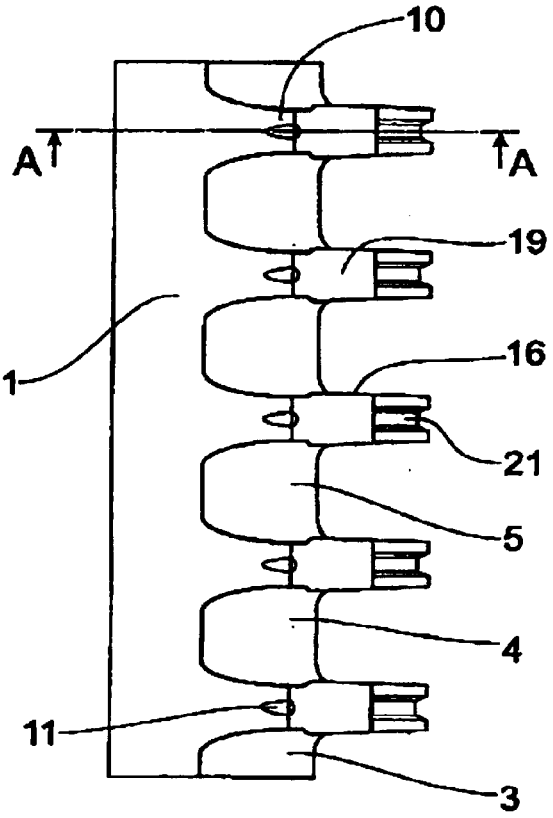
FIG. 4 shows a top plan view of the assembly of FIG. 3.

FIGS. 3 and 4 show respectively respective and upper plan views of the lip/tooth assemblies. From these views it will be noted that a substantial part of channels 11 is covered by the shroud portions 19 of teeth 16.

Figure 5:
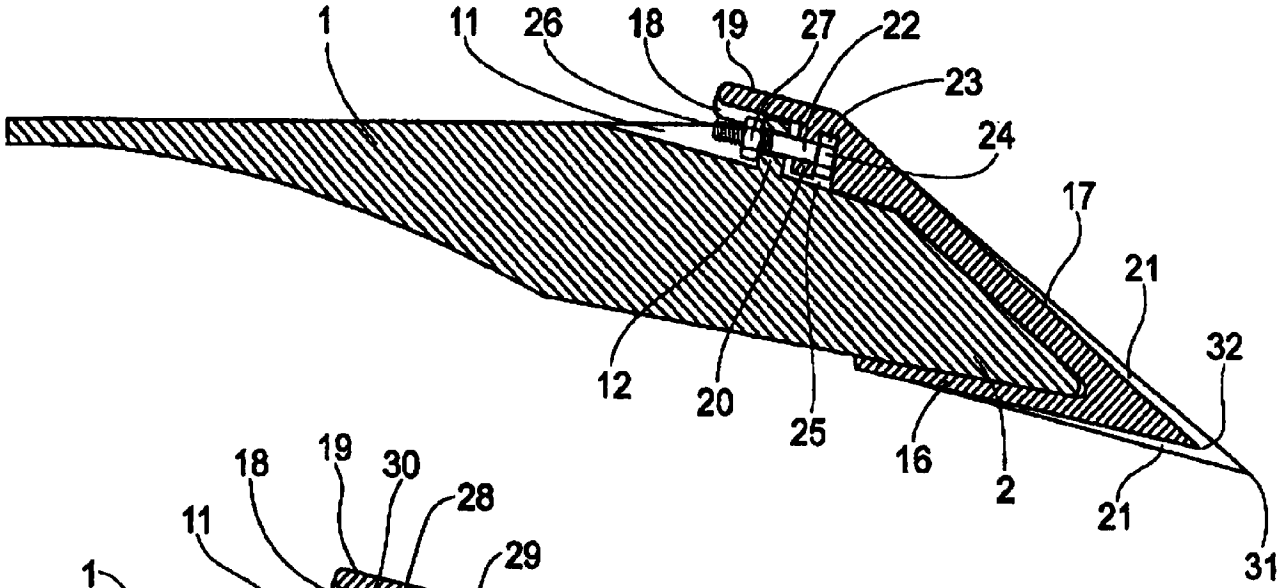
FIG. 5 is an enlarged cross-sectional view of the assembly through A—A in FIG. 4.

FIG. 5 shows a cross sectional view of the lip/tooth assembly through A—A in FIG. 4.

As shown in FIGS. 1 and 2, tapered nose 2 wedgingly engages in a corresponding tapered socket 17 formed in the rear portion of teeth 16.

Tooth 16 is removably secured to nose 2 by a screw-threaded bolt 22 captively secured in fastener locating member 20 with the bolt head 23 restrained from rotation by the engagement of bolt head flats 24 with side walls (not shown) of a head locating recess 25. The threaded shank 26 of bolt 22 extends through U shaped abutment 12 in channel 11 formed in the upper rear portion 10 of nose 2 and a nut 27 tensions bolt 22 against abutment 12 to wedgingly engage the tooth 16 on nose 2. Recessed channel 18 provides clearance for a socket driven, for example, by a pneumatic wrench to secure the tooth 16 under tension in a longitudinal axial direction to nose 2.

Figure 5A:
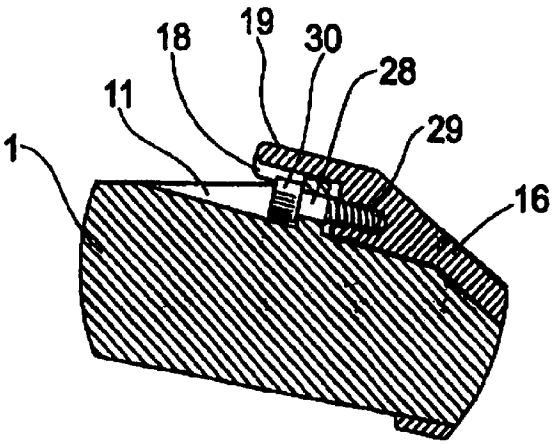
FIG. 5*a* is an enlarged cross-sectional view of an alternative configuration of the fastener system.

FIG. 5*a* shows an alternative configuration of fastening system wherein a socket headed cap screw 28 is screw threadably engaged in a threaded aperture 29 formed in tooth 16 with the head 30 of screw 28 engaging U-shaped abutment 12 under tension.

As shown in FIGS. 1, 2 and 3 ears 14 engage in slots 15 in the side of teeth 16 to resist upward movement of shroud portion 19 in use.

FIG. 5 shows more clearly the nature of the free end of tooth 16 with, in effect, three cutting edges formed by the tapered central channels 21 on the upper and lower surfaces of the tooth tip which create a pair of sharp leading edges 31 on opposite sides of a sharp trailing edge 32.

FIGS. 6 and 7 show respectively partial perspective and top plan views of an excavator bucket 35 fitted with a lip and tooth assembly 36 according to the invention.

For the sake of comparison with prior art replaceable tooth mounting systems, the bucket lip 37 is shown fitted with conventional intermediate adaptors 38 secured on respective noses 39 on opposite sides of bucket 35 by a spool and wedge connector or the like extending through aligned vertical apertures 40 in adaptor 38 and nose 39. Replaceable digging teeth 41 also are secured to a front nose portion of adaptors 38 by a spool and wedge, flex pin or the like extending through aligned apertures 42 in teeth 41 and the nose portions of the adaptors 38.

Trials carried out on a bucket having the general mouth configuration as shown in FIGS. 6 and 7 reveal drag energy reductions of up to 30% of the drag energy for conventional excavator buckets such as the COMS "Earth Eater" (Trade Mark) and equivalent ESCO and P&H buckets. It is considered that the tooth and lip system according to the invention is a considerable contribution to this drag energy saving.

Another significant advantage offered by the present invention is that the overall bucket mass may be reduced as large, heavy adaptor and tooth configurations to compensate for weakness to due lateral or vertical mounting apertures are no longer required. Indeed, as is illustrated in the drawings, adaptors may be eliminated entirely and relatively compact, low mass teeth may be employed.

It readily will be apparent to a person skilled in the art that the tooth/lip/mounting system according to the invention offers considerable advantages over prior art systems in that only a simple bolt or cap screw is required to secure the teeth to respective mounts and no special tools are required.

The bearing faces between the noses and teeth are maximised to withstand the large forces in a vertical plane and with no apertures in the tooth or nose through which abrasive earth particles can enter, wear resistance is maximised.

The smooth planar tapered engaging surfaces permit easy and rapid removal and replacement of teeth without the need for hammers or other impact devices.

Another advantage of the present invention is that the shrouded retaining bolts are not subject to wear as with other tooth retaining devices and, as such, may be reused or certainly replaced at very low cost compared with conventional locking pins.

Many modifications and variations may be made to the various aspects of the present invention without departing from the spirit and scope thereof.

Throughout this specification and claims which follow, unless the context requires otherwise, the word "comprise", and variations such as "comprises" or "comprising", will be understood to imply the inclusion of a stated integer or group of integers or steps but not the exclusion of any other integers

What is claimed is:

1. A mounting system for a digging tooth, said mounting system comprising:

an adaptor nose including a spigot having upper and lower bearing surfaces tapering convergently towards a free end of said nose, said adaptor nose having a connector abutment located in an upper portion of said nose remote from said free end; and, a digging tooth having a convergently tapering socket to receivably locate said adaptor nose, said digging tooth having a rearwardly extending shroud with a tooth coupling adapted to cooperate with a screw-threaded connector extending between said coupling and said abutment in a direction substantially parallel to a longitudinal axis of said digging tooth, said shroud extending over said tooth coupling and a free end of said screw-threaded connector, and shrouding at least portion of said nose rearwardly of said bearing surface, and further wherein said tooth coupling comprises a screw-threaded aperture in said tooth to receive a threaded end of a screw-threaded connector.

2. A system as claimed in claim 1 wherein said adaptor nose is formed integrally with an excavator bucket lip.

3. A system as claimed in claim 1 wherein said adaptor nose is formed on an adaptor member adapted, in use, for attachment to a lip of an excavator bucket.

4. A system as claimed in claim 3 wherein said adaptor member is releasably securable to said lip.

5. A system as claimed in claim 1 wherein said upper and lower bearing surfaces of said nose are planar.

6. A system as claimed in claim 1 wherein said digging tooth suitably has a convergently tapering socket complementary to said nose for wedging engagement therebetween.

7. A system as claimed in claim 1 wherein said screw-threaded connector comprises a bolt having a head engageable with said connector abutment.

8. A system as claimed in claim 1 wherein said digging tooth comprises upper and lower surfaces convergently tapering towards a free end of said tooth.

9. A system as claimed in claim 1 wherein said tooth has a channelled recess extending rearwardly from a free end thereof between opposite sides of said tooth over at least a portion of an upper surface and/or lower surface of said tooth.

10. A method of removably securing a digging tooth to an adaptor nose of the system of claim 1 wherein said screw-threaded connector is rotated against a connector abutment on said adaptor nose to draw respective socket and spigot portions of said tooth and said nose into engagement in a direction substantially parallel to a longitudinal axis of said tooth.

11. A system as claimed in claim 1 wherein said adaptor nose includes on opposing side walls thereof, outwardly projecting ears slidably engageable in corresponding slots of a respective digging tooth.

12. A lip for an excavator bucket, said lip comprising:

a body member;

a plurality of adaptor noses spaced along a leading edge of said body, said adaptor noses projecting parallel to each other away from said leading edge, said adaptor noses each having upper and lower bearing surfaces tapering convergently towards a free end thereof to receivably locate a respective digging tooth having a convergently tapering mounting socket, said lip characterised in that said digging tooth is removably secured to said lip by a screw-threaded connector extending between a tooth coupling associated with a rearwardly extending shroud on said tooth and a connector abutment located on a respective nose whereby said screw-threaded connector extends in a direction substantially parallel to a longitudinal axis of a respective tooth, each said rearwardly extending shroud extending over said tooth coupling and a free end of said screw-threaded connector, and shrouding at least portion of a respective said nose rearwardly of said bearing surfaces.

13. A lip as claimed in claim 12 wherein said adaptor noses are integrally formed with the lip body.

14. A lip as claimed in claim 12 wherein said adaptor noses are secured to said lip body.

15. A lip as claimed in claim 12 wherein a leading edge portion of said lip body between adjacent adaptor noses is contoured to provide a cutting edge.

16. A lip as claimed in claim 12 wherein each said adaptor nose includes, on opposite side walls thereof, outwardly projecting ears slidably engageable with corresponding slots of a respective digging tooth.

* * * * *